US008763676B2

(12) United States Patent
Barnes et al.

(10) Patent No.: US 8,763,676 B2
(45) Date of Patent: Jul. 1, 2014

(54) IDLE END ASSEMBLY

(75) Inventors: Antony Barnes, Stockport (GB); Andrew Greening, Sandbach (GB)

(73) Assignee: Louver-Lite Limited, Cheshire (GB)

( * ) Notice: Subject to any disclaimer, the term of this patent is extended or adjusted under 35 U.S.C. 154(b) by 0 days.

(21) Appl. No.: 13/321,984

(22) PCT Filed: Jun. 1, 2010

(86) PCT No.: PCT/GB2010/001079

§ 371 (c)(1), (2), (4) Date: Nov. 22, 2011

(87) PCT Pub. No.: WO2010/139945

PCT Pub. Date: Dec. 9, 2010

(65) Prior Publication Data

US 2012/0067530 A1 Mar. 22, 2012

(30) Foreign Application Priority Data

Jun. 2, 2009 (GB) ..... 0909439.2

(51) Int. Cl.
*E06B 9/174* (2006.01)

(52) U.S. Cl.
USPC ..... 160/323.1; 160/903

(58) Field of Classification Search
USPC ..... 160/323.1, 326, 370.22, 903; 296/98, 296/37.16
See application file for complete search history.

(56) References Cited

U.S. PATENT DOCUMENTS

| | | | | | |
|---|---|---|---|---|---|
| 3,099,916 | A | * | 8/1963 | Rosenbaum | 160/323.1 |
| 4,399,857 | A | | 8/1983 | Honma | |
| 5,029,629 | A | | 7/1991 | Cheng-Pei | |
| 5,031,682 | A | * | 7/1991 | Tedeschi | 160/315 |
| 5,464,052 | A | * | 11/1995 | Wieczorek et al. | 160/23.1 |
| 5,934,354 | A | * | 8/1999 | Price et al. | 160/370.22 |
| 6,131,643 | A | * | 10/2000 | Cheng et al. | 160/370.22 |
| 6,173,825 | B1 | | 1/2001 | Liu | |
| 2008/0142171 | A1 | * | 6/2008 | Koop et al. | 160/243 |

FOREIGN PATENT DOCUMENTS

| | | |
|---|---|---|
| DE | 202005006977 | 9/2005 |
| EP | 1936106 | 6/2008 |
| GB | 2339820 | 9/2000 |
| GB | 2392946 | 3/2004 |

* cited by examiner

*Primary Examiner* — David Purol
(74) *Attorney, Agent, or Firm* — Haugen Law Firm PLLP

(57) ABSTRACT

The present invention relates to a roller blind idle end assembly for roller blinds comprising a splined bush, a support bearing and an end pin, wherein the splined bush is supported by the support bearing and rotatable relative thereto in use; the end pin projects from the support bearing and is slidably coupled thereto such that the end pin is adapted to move axially relative to the support bearing and projects therefrom to engage with a receiving element of a mounting bracket; and wherein the end pin is rotationally fixed relative to the support bearing. This assembly reduces wear between an idle end pin and an idle end bracket and the likelihood of failure of the blind.

5 Claims, 5 Drawing Sheets

IDLE END ASSEMBLY

The present invention relates to a roller blind idle end assembly for reducing wear between an idle end pin and an idle end bracket and the likelihood of failure of the blind.

In conventional roller blinds, a roller tube is mounted between a pair of roller blind end plugs. This is typically achieved by providing the end plugs with a number of splines or fins which in use are located within the roller blind tube. At one end of the roller blind, the roller blind end plug is part of the control end assembly which operates the blind; at the other end, the other roller blind end plug is part of the idle end assembly. Typically, the roller blind idle end plug is mounted upon a sprung loaded idle end pin, which is located within an idle end bracket when the blind is fitted. Typically the idle end pin is fabricated in a plastic material, whilst the bracket is metal.

It is a problem with conventional idle end assemblies that during operation the idle end pin rotates within the idle end bracket. Over time, this relative rotation may cause extensive wearing of the plastic end pin.

In addition, the weight of the roller blind is supported by the end pin, which may have a relatively small diameter and resulting load bearing surface. Wearing of the end pin may therefore cause it to fail, resulting in the blind falling from its mounting.

The present invention seeks to address and/or ameliorate these problems.

German utility model (Gebrauchsmuster) DE 202005006977 describes a flyscreen which is supported by a roller mechanism with an end assembly comprising a splined bush and a support bearing which is slidably coupled to a peg projecting orthogonally from a planar head-end. The end assembly further includes a spring adapted to bias the peg and head-end out of the support bearing. If the head end is not fixably mounted to a substrate when the screen is in use, the weight of the flyscreen is supported solely by the axial force exerted by the spring urging the head-end against the substrate. A skilled person will appreciate that such force is insufficient to support the weight of a typical roller blind . If the head-end is fixably mounted to a substrate, the peg is not releasable from its mounting and it is not possible to remove the screen for cleaning or repair without removing the fixings.

UK patent application GB2339820 describes an end plug assembly for use in a roller blind comprising a splined bush and a two part telescopic support member and a core pin. The second part of the telescopic support member is slidably coupled to the first part, is able to move axially but is rotationally fixed thereto. This second part of the telescopic support member may project from the first part but does not engage with the mounting bracket. The core end pin is slidably coupled to the support member, is able to move axially but is not rotationally fixed thereto. The core end pin does not engage with any receiving element of the mounting bracket According to a first aspect of the invention, there is provided an idle end assembly for roller blinds comprising a splined bush, a support bearing , and an end pin, wherein the splined bush is supported by the support bearing and rotatable relative thereto in use; the end pin is slidably coupled to the support bearing such that it is able to move axially relative to the support bearing and projects therefrom to engage with a receiving element of a mounting bracket; and wherein the end pin is rotationally fixed relative to the support bearing.

For the avoidance of doubt, the idle end assembly comprises a splined bush, a support bearing and an end pin, and is a discrete component distinct from the bracket with which it engages in use.

An advantage of this assembly is that, when the blind is fitted and in use, there is relative rotation during operation of the blind between the splined bush and the support bearing rather than a typical end pin; the support bearing having a larger load bearing surface area than a typical idle end pin, and hence wear is significantly reduced.

In an embodiment of the invention, the end pin includes an engagement element which is adapted to engage with a corresponding receiving element of a mounting bracket to prevent relative rotation.

Such an arrangement prevents rotation of the end pin within a mounting bracket and hence prevents wear of the end pin.

In a further embodiment of the invention, the idle end assembly further includes a spring adapted to bias the end pin to project out of the support bearing. Suitably, the spring is a compression spring located between the support bearing and the end pin.

In a further embodiment of the invention, the engagement element is cruciform. A cruciform engagement element has the advantage of increasing the load bearing surface in contact with the mounting bracket and hence further prevents the risk of failure.

According to a second aspect of the invention, there is provided a roller blind comprising a control end assembly, idle end assembly and roller tube wherein the idle end assembly is as defined above.

In an embodiment of the invention, the roller blind further comprises a control end mounting bracket and an idle end mounting bracket for receiving, respectively, the control and idle end assemblies, wherein the mounting brackets each include a receiving element.

In a further embodiment, the idle end assembly includes an engagement element which engages with the receiving element of the idle end mounting bracket to prevent relative rotation.

In a further embodiment, the control end and idle end receiving elements are substantially identical.

It is a key feature of a typical roller blind that during operation, the engagement element of the control end assembly cannot rotate relative to the control end mounting bracket. It is a further advantage of the present invention that the engagement element of idle end assembly and corresponding receiving element of the idle end mounting bracket are adapted to prevent relative rotation that the receiving element of both the control end mounting bracket and idle end mounting bracket may be identical. This significantly simplifies manufacturing, stock requirements and installation of the roller blinds of the present invention.

In a yet further embodiment, the idle end mounting bracket and the control end mounting bracket are substantially identical. A typical roller blind will have the option of a "right hand" or "left hand" control end assembly depending upon installation requirements with corresponding idle end assemblies. The present invention enables the control end and idle end mounting bracket to be identical, thereby negating the requirement for a number of different brackets.

An embodiment of the invention will now be described, by way of example only, with reference to the accompanying drawings in which:

FIG. 1 is an exploded perspective view of an idle end assembly according to the invention;

FIGS. 2*a* and 2*b* are perspective views of the idle end assembly shown in FIG. 1 prior to installation; and FIGS. 3*a* and 3*b* are perspective views of the idle end assembly shown in FIG. 1, wherein the end pin is depressed as in use .

For the avoidance of doubt, the skilled person will appreciate that in this specification, the terms "up", "down", "front", "rear", "upper", "lower", "width", "above", "below", "axial" etc. refer to the orientation of the components of the invention when installed for normal use as shown in the Figures.

Figure 1:
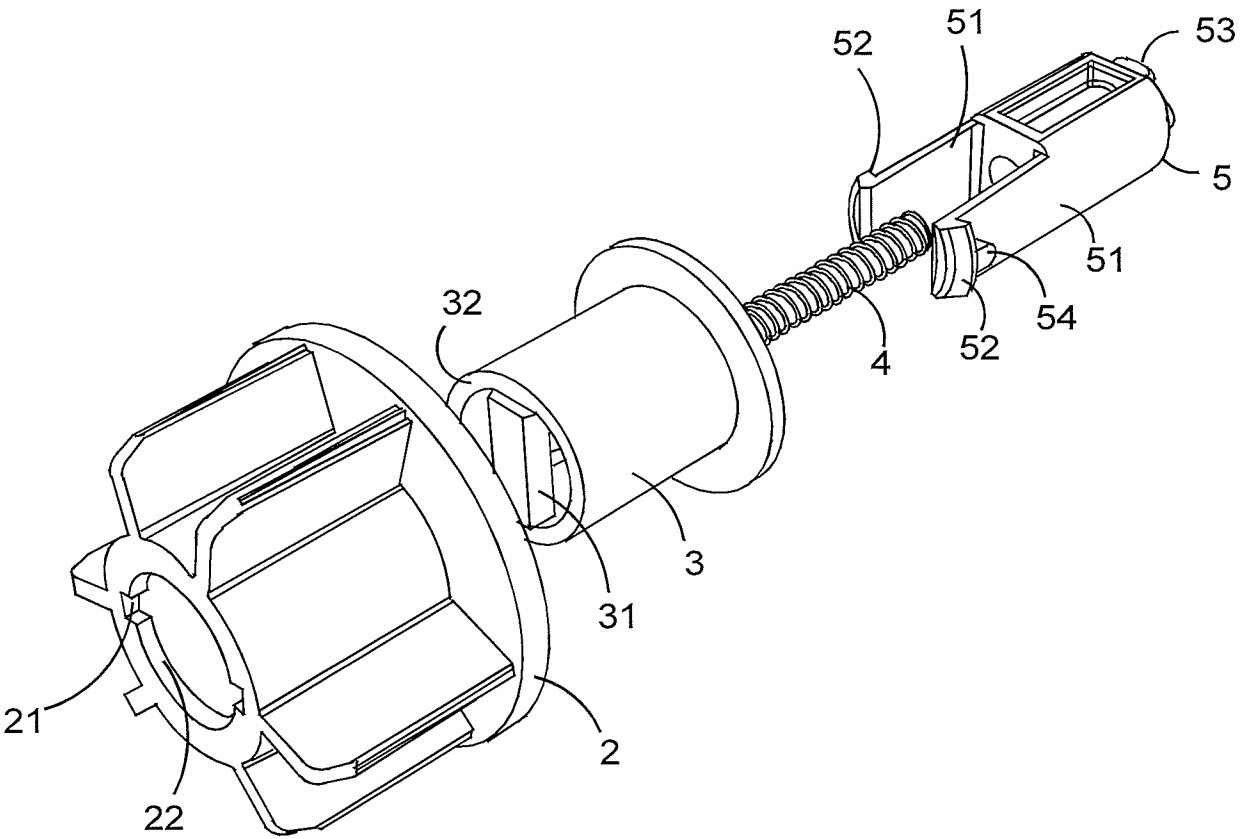

An idle assembly 1 according to the invention is shown in FIG. 1, FIG. 2 and FIG. 3. The idle end assembly 1 comprises a splined bush 2, a support bearing 3, a compression spring 4 and an end pin 5. The splined annular bush 2 is supported by the annular support bearing 3 and is rotatable relative thereto.

The support bearing 3 has an annular wall 32 and a diametric strut 31 located at one end thereof which bisects the cylindrical channel defined by the wall 32. The end pin 5 is slidably coupled to the support bearing 3 such that the pin is able to move axially relative to the support bearing. The pin 5 has a body part and a pair of opposed arms 51 which extend from the body; each arm 51 having a lug 52 and a lock tab 54. The arms 51 extend thorough and beyond the cylindrical cavity defined by the wall 32 and each arm is located on opposite sides of the strut 31, which thereby restricts rotation of the pin 5 relative to the support bearing 3. The compression spring 4 biases the body of the pin 5 to extend out of the support bearing 3.

Figure 4:
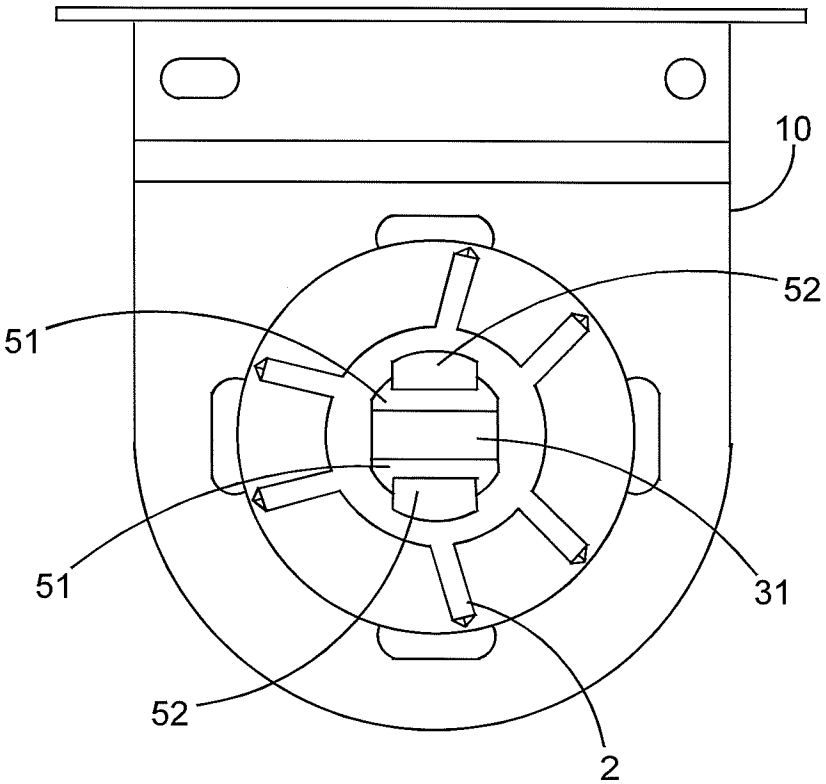
FIG. 4 is a perspective view of the idle end assembly shown in FIG. 1 engaged with an idle end mounting bracket.

The pin 5 has a cruciform engagement element 53 formed on an end face of the body which engages with a corresponding receiving element (not shown) of a mounting bracket 10 (as shown in FIG. 4) to prevent relative rotation of the pin 5 and the bracket 10.

Figure 2B:
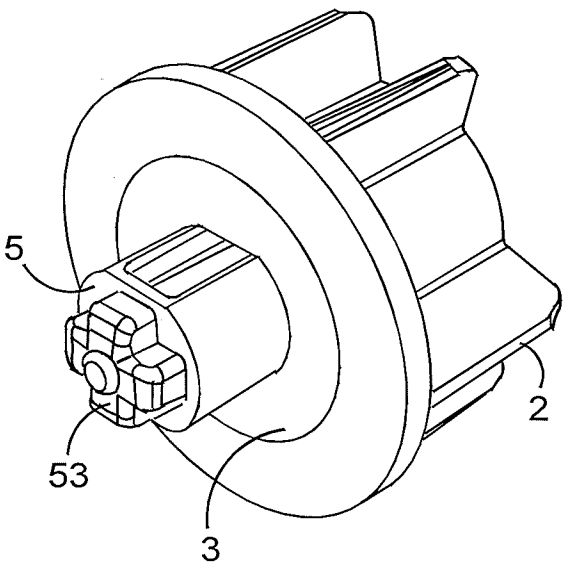
Figure 2A:
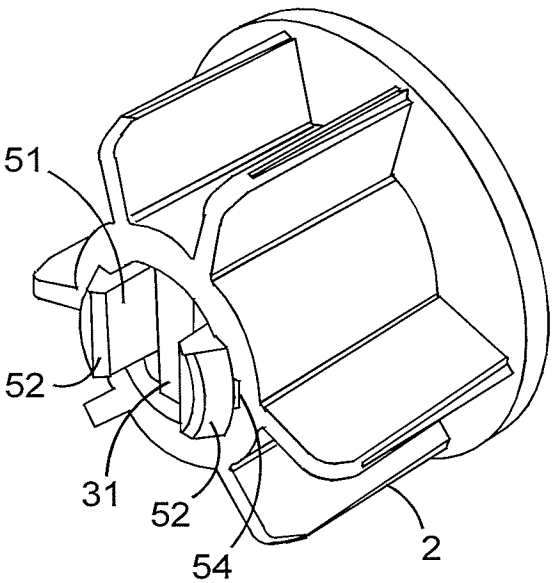

The idle end assembly prior to installation is shown in FIGS. 2*a* and 2*b*. The lock tabs 54 of lugs 52 are retained within corresponding notches 21 in an inwardly facing peripheral surface 22 of the splined bush 2. This prevents the rotation of the splined bush 2 relative to the end pin 5 prior to installation.

Figure 3B:
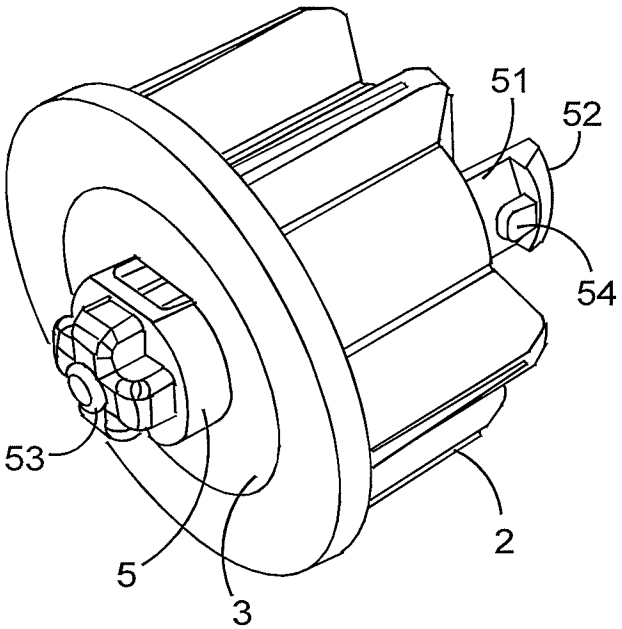
Figure 3A:
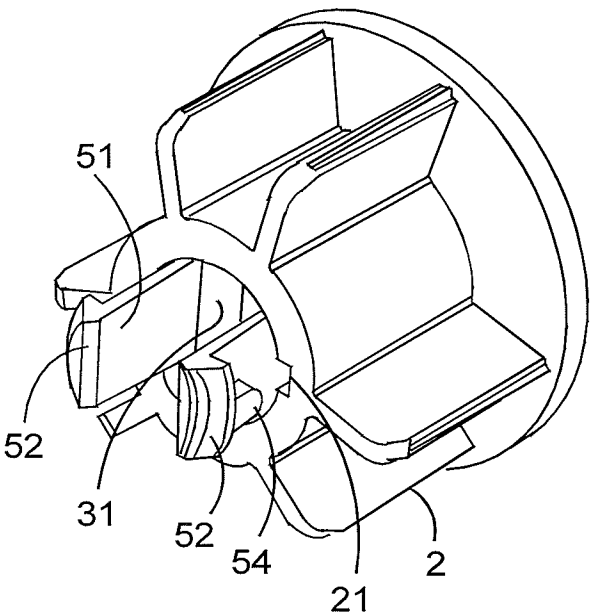

The idle end assembly 1 as in use is shown in FIGS. 3*a* and 3*b*. The end pin 5 is depressed axially relative to the support bearing 3 by a distance sufficient to allow insertion of the end pin 5 into an idle end mounting bracket 10, partially counteracting the bias of the compression spring 4. The lock tabs 54 of lugs 52 are disengaged from the notches 21 in the inwardly facing peripheral surface 22 of the splined bush 2 and there is free rotation of the splined bush 2 relative to the end pin 5 by virtue of the splined bush 2 being able to rotated relative to the support bearing 3, and the support bearing 3 being rotationally fixed to the end pin 5.

In use, cruciform engagement element 53 engages the corresponding receiving element (not shown) of the idle end mounting bracket 10, thus preventing the end pin 5 from rotating relative to the mounting bracket. The end pin 5 is sufficiently depressed within the support bearing 3 that the lock tabs 54 are disengaged from the corresponding notches 21, whereby the splined bush 2 is free to rotate about the support bearing 3. The rotation of the control end of the roller blind causes the roller tube and idle end splined bush 2 to rotate. The splined bush 2 rotates about the support bearing 3, which is fixed relative to the mounting bracket 10 via the end pin 5.

Figure 5:
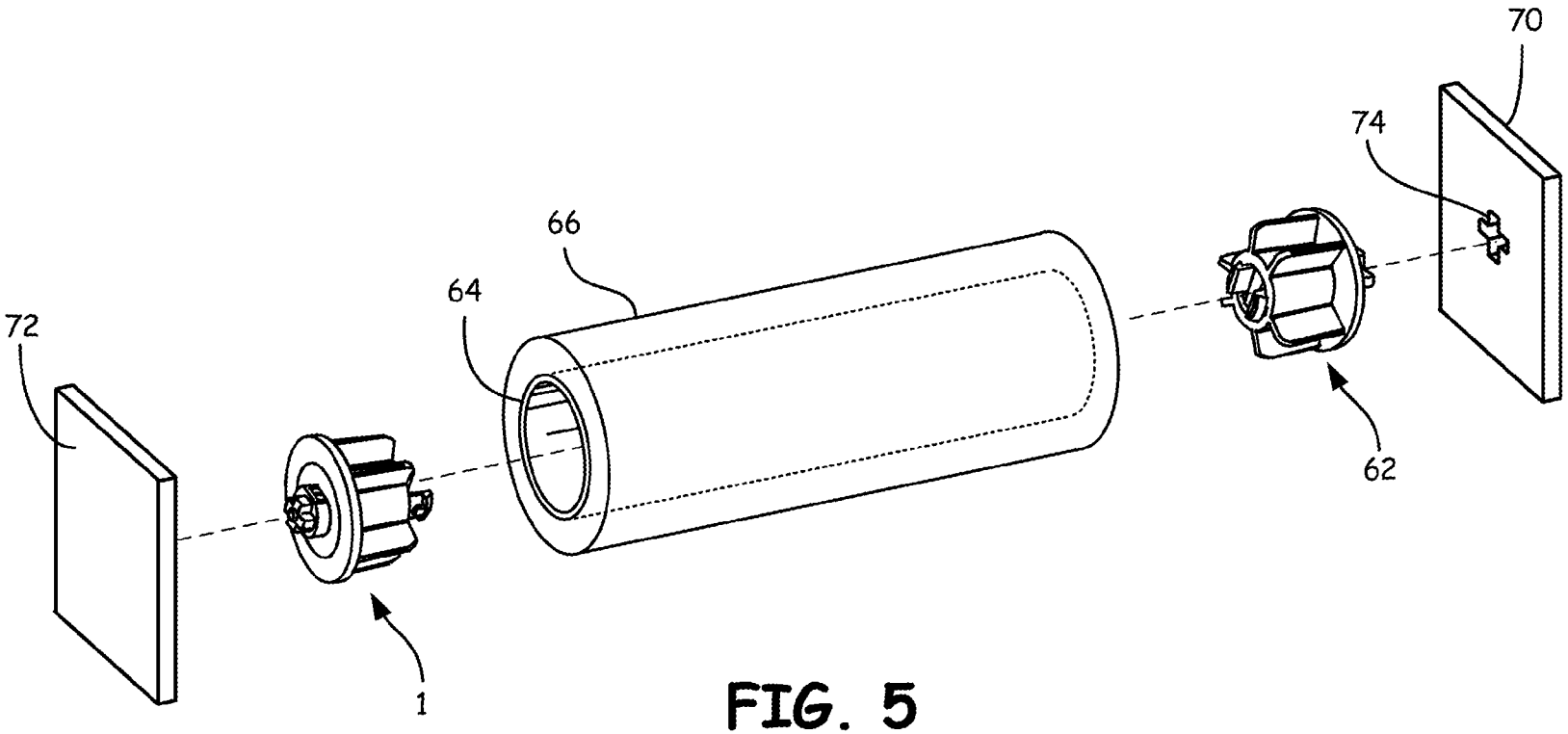
FIG. 5 is a perspective exploded view of a roller blind according to the invention.

As illustrated in FIG. 5, a roller blind 60 includes a control end assembly 62, an idle end assembly 1, and a roller tube 64 supporting a blind 66. Roller blind 60 further includes a control end mounting bracket 70 and an idle end mounting bracket 72 for receiving, respectively, the control and idle end assemblies 62, 1 wherein the mounting brackets 70, 72 each include a receiving element 74.

The invention claimed is:

1. An end assembly for a roller blind, comprising:

a connection member for connecting to and rotating with a roller tube of the roller blind;

a support bearing having an annular wall defining a cylindrical channel, said support bearing being in contact with and supporting said connection member, wherein said connection member is rotatable relative to said support bearing, and wherein said support bearing includes a strut extending between diametrically opposed portions of the channel defined by said annular wall; and an end pin axially slidably coupled to said support bearing, said end pin including first and second opposed arms extending from a body portion of said end pin, wherein said strut is disposed between said first and second arms to restrict rotation of the end pin relative to said support bearing, said end pin extending from said support bearing and including an engagement element configured to engage with a receiving element of a mounting bracket to prevent relative rotation between the mounting bracket and said end pin.

2. An end assembly as in claim 1, wherein said connection member includes a pair of opposed receiving channels, said first and second arms of said end pin include a respective locking tab, and said end pin has a first axial position in which said locking tabs are received within respective receiving channels to prevent relative rotation between said connection member and said end pin, and a second axial position in which said locking tabs are spaced from said receiving channels such that said connection member is rotatable about said support bearing relative to said end pin.

3. A roller blind, comprising:

a roller tube;

a control end assembly; and an idle end assembly having:

(i) a connection member connected to said roller tube for rotating with said roller tube about an axis;

(ii) a support bearing having an annular wall defining a cylindrical channel along said axis, wherein said connection member is rotatably supported such that said connection member is rotatable relative to said support bearing, and said support bearing including a strut extending between diametrically opposed portions of said annular wall and bisecting said channel; and (iii) an end pin axially movably associated with said support bearing, said end pin including first and second opposed arms extending from a body portion of said end pin, wherein said strut is positioned between said first and second arms as end portions of said first and second arms protrude from said cylindrical channel to restrict rotation of said end pin relative to said support bearing.

4. A roller blind as in claim 3, including lugs extending radially outwardly from respective said end portions of said first and second arms, wherein said lugs are engagable with said connection member to prevent rotation of said connection member relative to said end pin.

5. A roller blind as in claim 4, including lock tabs on said lugs, wherein said lock tabs are engagable within respective notches in a radially inwardly facing peripheral surface of said connection member.

* * * * *